US005915699A

United States Patent [19]

Potter et al.

[11] Patent Number: 5,915,699

[45] Date of Patent: Jun. 29, 1999

[54] HEATED ENCLOSURE

[75] Inventors: Jerry Fuller Potter, Seaford, Del.; Melvin Harry Johnson, Chadds Ford, Pa.

[73] Assignee: E. I. du Pont de Nemours and Company, Wilmington, Del.

[21] Appl. No.: 08/955,641

[22] Filed: Oct. 24, 1997

[51] Int. Cl.[6] ..... B65H 57/02

[52] U.S. Cl. ..... 28/178; 28/172.1; 28/247; 28/271

[58] Field of Search ..... 28/172.2, 178, 28/179, 180, 217, 220, 240, 249, 258, 172.1, 247; 57/310, 287, 315; 264/211.12, 211.18, 211.2

[56] References Cited

U.S. PATENT DOCUMENTS

| | | | |
|---|---|---|---|
| 2,402,652 | 6/1946 | Martin | 28/179 |
| 3,791,132 | 2/1974 | Schutz et al. | 28/179 |
| 4,825,517 | 5/1989 | Hagler | 28/220 |
| 5,259,098 | 11/1993 | Gupta | 28/246 |
| 5,277,858 | 1/1994 | Neal | 264/210.8 |
| 5,653,010 | 8/1997 | Grossebbacher et al. | 28/247 |
| 5,755,086 | 5/1998 | Hlbheer et al. | 28/247 |

FOREIGN PATENT DOCUMENTS

| | | | |
|---|---|---|---|
| 1112072 | 9/1984 | U.S.S.R. | 28/246 |
| 1023089 | 3/1966 | United Kingdom . | |

*Primary Examiner*—John J. Calvert
*Assistant Examiner*—Larry D. Worrell, Jr.

[57] ABSTRACT

A baffle structure that includes a generally cylindrical portion and at least one generally linear portion is associated with each roll in a yarn processing. The generally cylindrical portion is spaced a predetermined clearance distance from the surface of the roll with which it is associated to define a generally curved channel about the roll. The generally linear portion of each baffle structure extends toward the other roll, with the generally linear portions overlapping each other to define a substantially linear channel between adjacent upstream and the downstream rolls. The generally linear portion extending from the cylindrical portion of the upstream roll toward the downstream roll has an edge thereon. The edge is disposed within a predetermined close distance of the surface of the upstream roll such that the edge lies within the boundary layer of air able to be generated about the upstream roll. The generally curved channels and the substantially linear channel cooperating to define a pathway that substantially encloses the warp array of yarns as the same is moved over and between the rolls. In operation, a substantially uniform transverse temperature is maintained across the pathway at each point therealong, and at least a portion of the heated air about the upstream roll is stripped therefrom as yarn is conveyed from the upstream to the downstream roll.

4 Claims, 3 Drawing Sheets

HEATED ENCLOSURE

BACKGROUND OF THE INVENTION

1. Field of the Invention

The present invention is directed toward a heated enclosure for a synthetic yarn processing apparatus.

2. Description of the Prior Art

In the processing of synthetic yarn it is well known to enclose heated rolls, such as heated draw rolls, in order to conserve heat and to maintain uniformity of heat transfer along the path of travel of a moving threadline. Representative of such arrangements are those disclosed in U.S. Pat. No. 5,277,858 (Neal), U.S. Pat. 5,259,098 (Gupta), and U. K. Patent 1,023,089 (Allied Chemical Corporation). These arrangements served to enclose the total space occupied by the draw rolls. No particular attention is made to enclose the relatively confined volume through which the yarn travels.

Such arrangements are believed to have thermally efficiencies associated therewith. Large thermal differences are generated when the enclosure is opened. Moreover, since heated air remains enveloped about each individual roll is not conveyed from roll to roll, the yarn experiences relatively large thermal gradients as it is conveyed from roll to roll.

It view of the foregoing it is believed advantageous to provide a more thermally efficient enclosure arrangement that is tailored to correspond to the path of travel of the yarn, as opposed to the members over which the yarn is conveyed, in order to define a pathway for the yarn that maintains the yarn in an environment having a substantially uniform temperature. It is also believed to be advantageous to provide an enclosure arrangement whereby heated gas is conveyed with the yarn as it moves from roll to roll through the apparatus.

SUMMARY OF THE INVENTION

The present invention is directed to an apparatus for processing a warp array of synthetic yarns of the type that includes at least an upstream heated cylindrical roll and a downstream heated cylindrical roll. The rolls are rotationally mounted with respect to a faceplate. One or more synthetic yarns are conveyed over the surface of each roll. As each roll is rotated a boundary layer of heated air having a predetermined thickness is able to be generated about the roll.

In accordance with the present invention a baffle structure having a mounting end and a free end is associated with each roll. The baffle structure is mounted at its mounting end to the faceplate. Each baffle structure includes a generally cylindrical portion and at least one generally linear portion. The generally cylindrical portion of each baffle structure is spaced a predetermined clearance distance from the surface of the roll with which it is associated. Each generally cylindrical portion of each baffle structure and the surface of the roll with which it is associated cooperate to define a generally curved channel about the roll.

The generally linear portion of each baffle structure extends from the cylindrical portion toward the other roll, with the generally linear portions of the baffle structures overlapping each other to define a substantially linear channel between the upstream and the downstream rolls. The generally linear portion extending from the cylindrical portion of the upstream roll toward the downstream roll having an edge thereon. The edge is disposed within a predetermined close distance of the surface of the upstream roll such that the edge lies within the boundary layer of air able to be generated about the upstream roll. The generally curved channels and the substantially linear channel cooperating to define a pathway that substantially encloses the warp array of yarns as the same is moved over and between the rolls.

In operation, a substantially uniform transverse temperature is maintained across the pathway at each point therealong, and at least a portion of the heated air about the upstream roll is stripped therefrom as the warp array of yarns is conveyed from the upstream to the downstream roll.

The apparatus may further include a texturizer assembly spaced downstream of the downstream roll. A transfer plate is disposed between the cylindrical portion of the baffle structure associated with the downstream roll and the texturizer assembly. The transfer plate has a plurality of channels formed therein. Each of the channels receives one of the yarns in the warp array. The channels serve to substantially enclose the yarn therein as the same is conveyed from the downstream roll to the texturizing assembly.

BRIEF DESCRIPTION OF THE DRAWINGS

The invention will be more fully understood from the following detailed description thereof, taken in connection with the accompanying drawings, which form a part of this application, and in which.

DETAILED DESCRIPTION OF THE INVENTION

Figure 1:
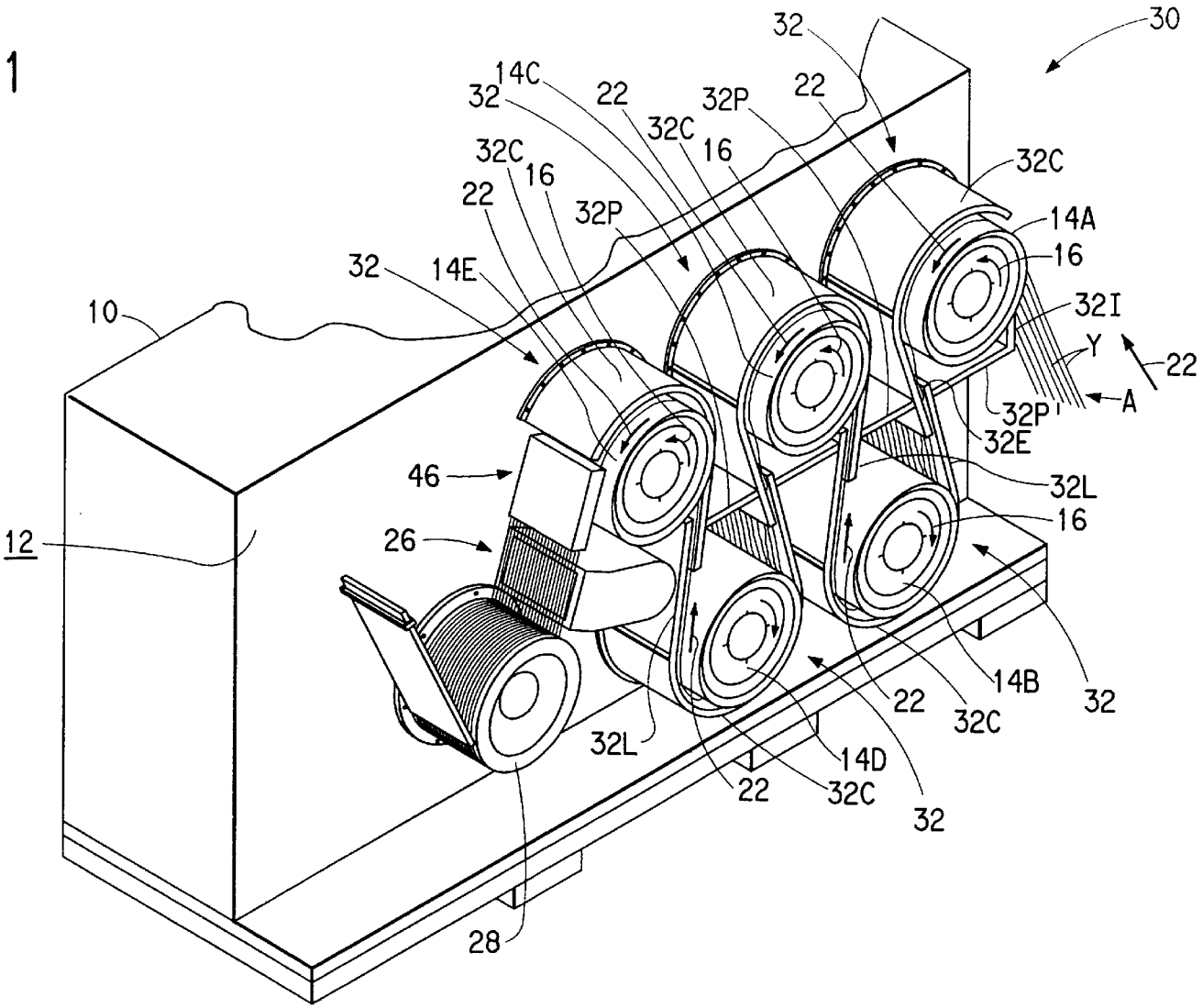
FIG. 1 is a perspective view of a draw module of an apparatus for processing yarns arranged in a warp array.

Throughout the following detailed description similar reference numerals refer to similar elements in all Figures of the drawings.

FIG. 1 is a perspective view of a draw module for processing plural yarns Y organized in a warp configuration A with which the present invention finds utility. By "warp configuration" it is meant that the plural yarns Y comprising the warp are arranged in a transversely extending, generally planar array in which the individual yarns comprising the warp are substantially parallel to each other.

The draw module includes a cabinet 10 having a faceplate 12 from which extend a plural number (i.e., two or more) of cylindrical, heated draw rolls 14A through 14E. Any convenient number of draw rolls may be used. Each of the draw rolls 14A–14E is rotated in a predetermined direction of rotation (indicated by the arrow 16) by a motive source disposed within the cabinet. The surface of these rolls may reach temperatures of about two hundred thirty degrees Centigrade (230° C.). The induction coils to heat the rolls are disposed internally of the rolls.

The yarns Y in the warp array A are pulled along a generally serpentine path of travel through the module. The path of travel, indicated in the Figures by the reference arrows 22, takes the yarns sequentially over the cylindrical surface of each of the rolls 14A through 14E. Downstream, in the direction of yarn travel 22, of the final draw roll 14E is a texturizer assembly 26 implemented in the form of a bulking jet. From the texturizer assembly 26 the yarns are deposited on the surface of a drum 28.

Figure 2:
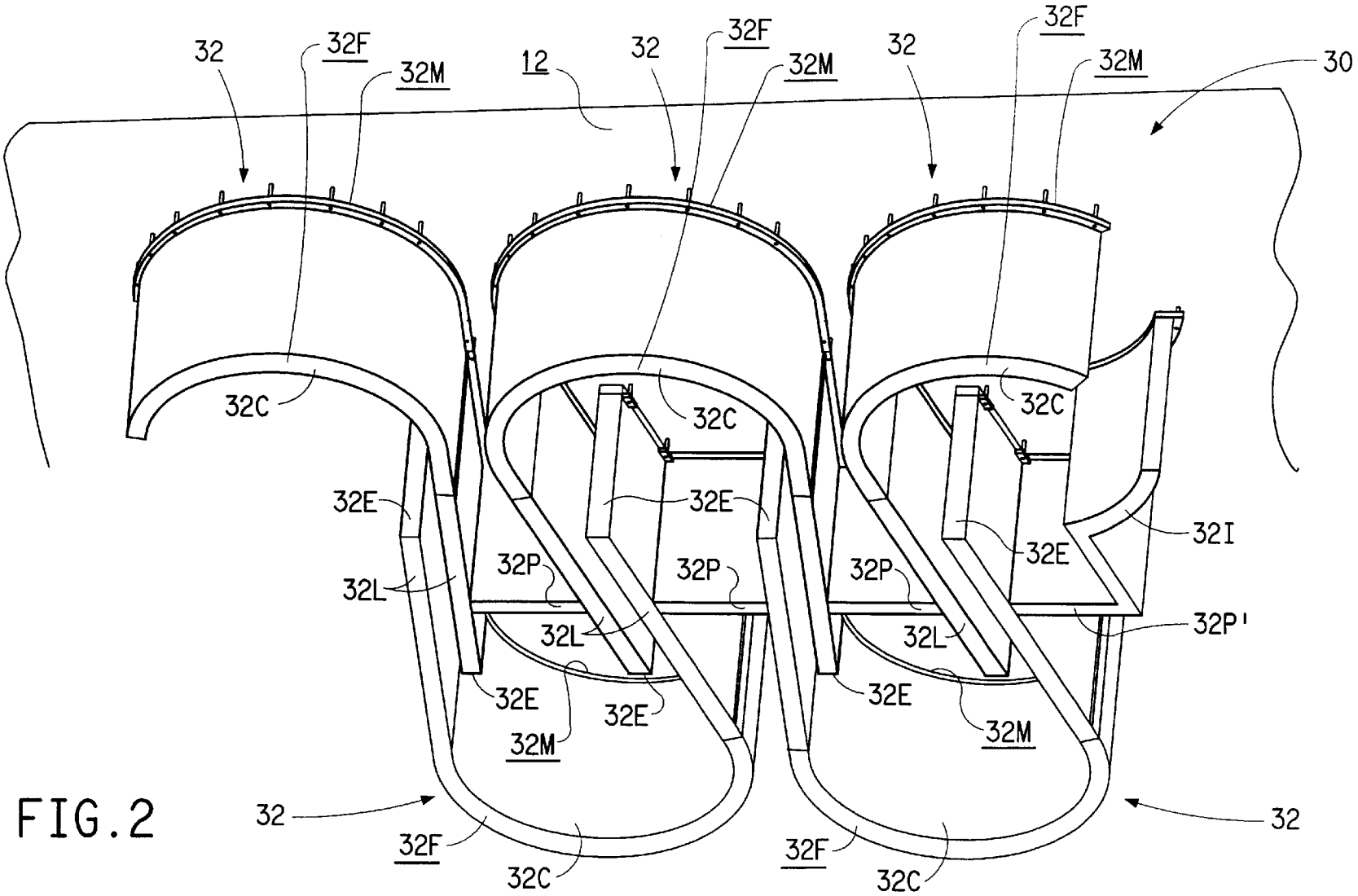
FIG. 2 is an isolated perspective view of a baffle structure used with the draw module of FIG. 1.
Figure 4:
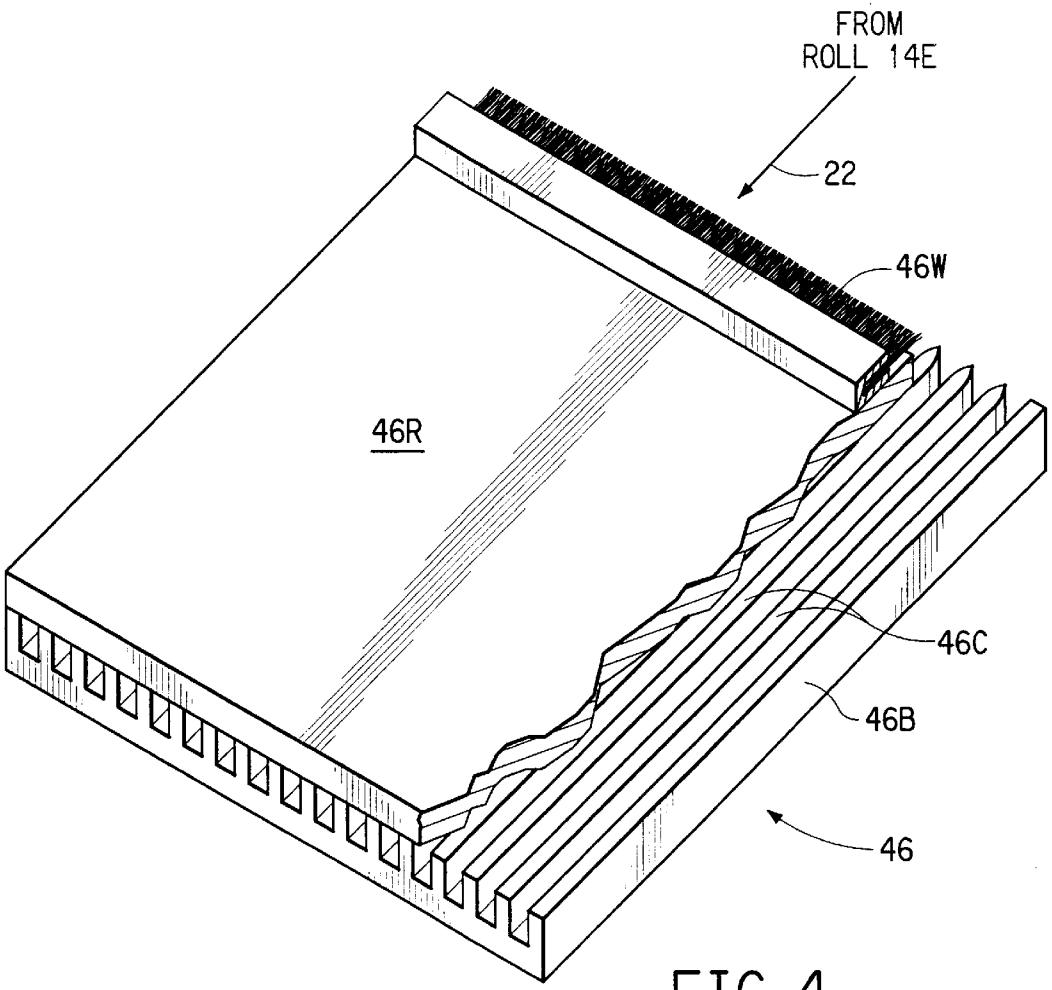
FIG. 4 is an isolated perspective view of a transfer plate used with the draw module of FIG. 1.

The present invention relates to a heat enclosure assembly generally indicated by the reference character 30 (FIG. 2). The heat enclosure assembly 30 maintains a uniform temperature transversely across the warp at each point along its path of travel 22 through the draw rolls. As will be discussed herein the heat enclosure assembly 30 is believed to improve the heating efficiency of the multi-roll system.

The heat enclosure assembly 30 comprises a baffle structure 32 associated with each roll 14A through 14E. Each baffle structure 32 has an inner, mounting, end 32M and a free end 32F. The baffle structures 32 are each mounted at their respective mounting ends 32M to the faceplate 12.

In the general case each baffle structure 32 includes a generally cylindrical portion 32C and at least one generally linear portion 32L. Each of the linear portions 32L has an edge 32E thereon. Only the edges 32E of further interest herein are indicated in the drawings, for economy of illustration. Depending upon the particular roll 14 with which the baffle structure 32 is associated a second linear portion 32L may be provided. The baffle structure 32 is a laminated structure formed from inner and outer sheets of stainless steel that enclose a layer of fiberglass thermal insulation.

Figure 3:
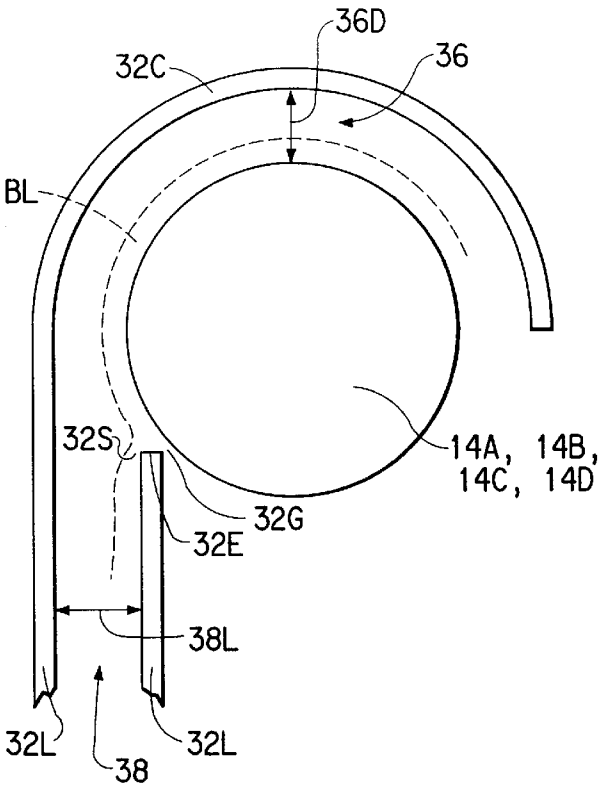
FIG. 3 is a side elevational view of an upstream roll illustrating the relationship between it and the linear portion of the baffle associated the downstream roll.

As is perhaps best seen in FIG. 3 the generally cylindrical portion 32C of each baffle structure 32 is spaced a predetermined clearance distance 36D from the surface of the roll 14 with which it is associated, whereby each generally cylindrical portion 32C of each baffle structure 32 and the surface of the roll with which it is associated cooperate to define a generally curved channel 36 surrounding the roll 14. The generally cylindrical portion 32C of each baffle structure extends on the order of about one hundred eighty degrees about the circumference of the draw roll. The dimension 36D of the channel 36 is typically on the order of one (1) inch. For convenience the channel 36 should be large enough to accept an commercial aspirating device for re-stringing yarn about the roll, as for example, in the event of yarn break.

The generally linear portion 32L of each baffle structure 32 extends from its cylindrical portion 32C toward the one (or two) adjacent draw rolls that is(are) next sequentially adjacent along the path of travel 22 of the warp. As seen in the Figures, for the case of the baffle 32 associated with the rolls 14A and 14E only a single linear portion 32L is required, and that respective linear portion 32L extends toward the roll 14B, 14D, disposed downstream and upstream, respectively, thereof. In the case of the baffle structure 32 associated with the rolls 14B, 14C and 14D, each cylindrical portion 32C has a pair of linear portions 32L that extend toward both the adjacent upstream and the adjacent downstream adjacent rolls.

In every case, however, the generally linear portions 32L of the sequentially adjacent baffle structures 32 overlap each other thereby to define a substantially linear channel 38 between the adjacent rolls. The dimension 38L of the channel 38 between the overlapping linear portions 32L is preferably sized to substantially equal the dimension of the gap 34 defined between the roll surface and the cylindrical portion 32C, thereby to limit turbulence in air flow through the channels being defined.

Suitable brace plates 32P may be disposed between laterally adjacent linear portions 32L to stiffen the enclosure structure. In addition, if desired, a greater portion of the periphery of the inlet roll 14A may be further surrounded by an upwardly extending cylindrical member 32I conveniently supported by a brace plate 32P'. Alternate arrangements may be used about the inlet roll 14A. For example, the inlet member 32I may angle downwardly and cooperate with a correspondingly downwardly angled second linear portion attached at the free upstream end of the cylindrical portion 32C thereby to define an inlet hood leading to the roll 14A.

As is best seen in FIG. 3, in accordance with the present invention it is important that the edge 32E of the generally linear portion 32L extending from the cylindrical portion 32C of a downstream roll toward the adjacent upstream roll is disposed within a predetermined close distance 32G of the surface of the upstream roll. Thus, the edge 32E of the linear portion 32L extending from the downstream rolls (14B through 14E) toward the respective upstream rolls (14A through 14D) lies within a predetermined distance 32G of the surface of the latter rolls. The distance 32G should be such that the edge 32E lies within the boundary layer of air formed about the upstream roll as yarn is conveyed thereover. The dimension of the distance 42 is determined by the diameter and speed of the upstream roll and the temperature of the air. Typically, for a roll that is twenty (20) inches in diameter operating at a speed on the order of three thousand (3,000) meters per minute, this distance 32G is on the order of 0.375 inch. In some instances it may be desirable to extend the edge 32E into physical contact with the surface of the roll to promote aerodynamic channeling of the boundary layer from the upstream roll. In this event a strip of high temperature plastic material such that sold by E. I. du Pont de Nemours and Company and sold as Kapton® film is mounted to the edge 32E of the linear portion 32L.

In operation, the generally curved channels 36 surrounding each roll 14 together with the substantially linear channel 38 cooperate to define a pathway that substantially encloses the warp array of yarns, thereby to maintain a substantially uniform transverse temperature across the warp at each point along the pathway through which the warp is conveyed. Thus, at each point along the serpentine path 22 of travel over the rolls 14, each yarn in the transversely extending warp array is contained within the pathway and experiences substantially the same temperature.

In addition, the edge 32E of the linear portions 32L that extend to within the close distance 32G of their adjacent upstream roll strips a portion of the hot gas layer surrounding the roll as the yarns are conveyed through the rolls. This effect is indicated at reference character 32S in FIG. 3.

When the rolls rotate, they pump air. As the diameter and speed of the rolls increase the amount of pumped air grows. When rolls rotate in an enclosed box with a large space between the wall of the box and the roll, the air pump circulates with the roll. When a close fitting serpentine enclosure as described herein is placed around a roll with linear portions positioned close to the roll exit generally in the area of the boundary layer of hot air rotating around the roll, a layer of hot gas is stripped form the roll. This hot gas proceeds along the pathway surrounding the moving yarns. Pumping of hot gas with the yarn limits thermal losses and increases the effective heating length from about ten (10) to twenty (20) percent depending on the roll speed and cover geometry. Hot gases which exit the cover can be recycled to the inlet roll to conserve energy. Because thermal losses increase as roll speeds and temperature increase, use of the shaped enclosures as disclosed herein greatly extends the heat transfer and speed potential of a warp process. It is noted that as the air layer is stripped from the rolls and is conveyed as a substantially laminar flow with the yarn, the air becomes heated and expands. This causes an outflow of heated air along the axis of the rolls which emanates from the free ends of the baffle structure 32, and prevents aspirating of colder air into the pathway.

Mounted to the faceplate between the cylindrical portion 32C of the baffle structure 32 associated with the most downstream one 14E of the draw rolls is a transfer plate 46. The transfer plate 46 includes a base 46B having a plurality of channels 46C formed therein. Each of the channels 46C in the transfer plate 46 receives one of the yarns Y in the warp array A. The entrance to the channels 46C at the upstream end of the plate at tapered, to minimize creation of turbulence as the yarn exit the roll 14E. The channels 46C serve to substantially enclose each yarn as the same is conveyed from the downstream roll 14E to a texturizer assembly. A cover 46R has a wire or bristle brush 46W mounted at the upstream end to capture any broken filaments on the yarn as it exits the roll 14E.

Although described in terms of a warp array of yarns, it should be apparent from the foregoing that the invention is equally applicable to an apparatus through which a single yarn is conveyed.

Those skilled in the art, having the benefit of the teachings of the present invention as hereinabove set forth, may effect numerous modifications thereto. For example, the teachings of the present invention may be applied to form an enclosure for a single roll in which a member performs the function of the edge of the linear portion to strip the boundary layer from the surface of the roll. Such modifications are to be construed as lying within the contemplation of the present invention, as defined by the appended claims.

What is claimed is:

1. In an apparatus for processing a synthetic yarn that includes at least one heated roll having a cylindrical surface, the roll being rotationally mounted with respect to a faceplate, at least one yarn being able to be conveyed over the surface of the roll, as each roll is rotated a boundary layer of heated air having a predetermined thickness is able to be generated about the roll, the improvement comprising:

a baffle structure associated with the roll, the baffle structure having a mounting end and a free end, each baffle structure being mounted at its mounting end to the faceplate, each baffle structure including a generally cylindrical portion spaced a predetermined clearance distance from the surface of the roll, the generally cylindrical portion of the baffle structure and the surface of the roll cooperating to define a generally curved channel about the roll, a member having an edge thereon, the edge being disposed within a predetermined close distance of the surface of the roll such that the edge lies within the boundary layer of air able to be generated about the roll, such that, in operation, at least a portion of the heated air about the roll is stripped therefrom as the yarn is conveyed over the roll.

2. In an apparatus for processing a synthetic yarn that includes at least an upstream heated roll and a downstream heated roll, each roll having a cylindrical surface, the rolls being rotationally mounted with respect to a faceplate, at least one yarn being able to be conveyed over the surface of each roll, as each roll is rotated a boundary layer of heated air having a predetermined thickness is able to be generated about the roll, the improvement comprising:

a baffle structure associated with each roll, the baffle structure having a mounting end and a free end, each baffle structure being mounted at its mounting end to the faceplate, each baffle structure including a generally cylindrical portion and at least one generally linear portion, the generally cylindrical portion of each baffle structure being spaced a predetermined clearance distance from the surface of the roll with which it is associated, each generally cylindrical portion of each baffle structure and the surface of the roll cooperating to define a generally curved channel about the roll, the generally linear portion of each baffle structure extending from the cylindrical portion toward the other roll, the generally linear portions of the baffle structures overlapping each other to define a substantially linear channel between the upstream and the downstream rolls, the generally linear portion extending from the cylindrical portion of the upstream roll toward the downstream roll having an edge thereon, the edge being disposed within a predetermined close distance of the surface of the upstream roll such that the edge lies within the boundary layer of air able to be generated about the upstream roll, the generally curved channels and the substantially linear channel cooperating to define a pathway that substantially encloses the yarn as the same is moved over and between the rolls, such that, in operation, a substantially uniform transverse temperature is maintained across the pathway at each point therealong, and at least a portion of the heated air about the upstream roll is stripped therefrom as the yarn is conveyed from the upstream to the downstream roll.

3. In an apparatus for processing a warp array of synthetic yarns, the apparatus including at least an upstream heated roll and a downstream heated roll, each roll having a cylindrical surface, the rolls being rotationally mounted with respect to a faceplate, the warp array of synthetic yarns being conveyed over the surface of each roll, as each roll is rotated a boundary layer of heated air having a predetermined thickness is able to be generated about the roll, the improvement comprising:

a baffle structure associated with each roll, the baffle structure having a mounting end and a free end, each baffle structure being mounted at its mounting end to the faceplate, each baffle structure including a generally cylindrical portion and at least one generally linear portion, the generally cylindrical portion of each baffle structure being spaced a predetermined clearance distance from the surface of the roll with which it is associated, each generally cylindrical portion of each baffle structure and the surface of the roll cooperating to define a generally curved channel about the roll, the generally linear portion of each baffle structure extending from the cylindrical portion toward the other roll, the generally linear portions of the baffle structures overlapping each other to define a substantially linear channel between the upstream and the downstream rolls, the generally linear portion extending from the cylindrical portion of the upstream roll toward the downstream roll having an edge thereon, the edge being disposed within a predetermined close distance of the surface of the upstream roll such that the edge lies within the boundary layer of air able to be generated about the upstream roll, the generally curved channels and the substantially linear channel cooperating to define a pathway that substantially encloses the warp array of yarns as the same is moved over and between the rolls, such that, in operation, a substantially uniform transverse temperature is maintained across the pathway at each point therealong, and, at least a portion of the heated air about the upstream roll is stripped therefrom as the warp array of yarns is conveyed from the upstream to the downstream roll.

4. The apparatus of claim 3, wherein the apparatus further includes a texturizer assembly spaced downstream of the downstream roll, the improvement further comprising:

a transfer plate disposed between the cylindrical portion of the baffle structure associated with the downstream roll and the texturizer assembly, the transfer plate having a plurality of channels formed therein, each of the channels receiving one of the yarns in the warp array, the channels serving to substantially enclose the yarn therein as the same is conveyed from the downstream roll to the texturizing assembly.

* * * * *